United States Patent [19]

Uht

[11] 3,965,838

[45] June 29, 1976

[54] BACKWASH BAFFLE AND STABILIZING DEVICE FOR PROPELLER DRIVEN WATERCRAFT

[75] Inventor: Frank O. Uht, Bellevue, Wash.

[73] Assignee: Jack Hughes, Bellevue, Wash. ; a part interest

[22] Filed: May 27, 1975

[21] Appl. No.: 581,160

[52] U.S. Cl. ..... 114/145 A

[51] Int. Cl.[2] ..... B63H 25/48

[58] Field of Search ..... 114/145 A, 145 R, 66.5 P; 415/8; 115/17, 18

[56] References Cited

UNITED STATES PATENTS

| | | | |
|---|---|---|---|
| 2,050,336 | 8/1936 | Karasinski | 115/17 |
| 2,719,503 | 10/1955 | Smith | 114/145 A |
| 2,787,974 | 4/1957 | Johnson | 114/145 A |
| 3,091,977 | 6/1963 | Kiekhaefer | 115/18 R |
| 3,117,548 | 1/1964 | Rasmussen | 114/145 A |

*Primary Examiner*—Trygve M. Blix
*Assistant Examiner*—Gregory W. O'Connor
*Attorney, Agent, or Firm*—Wells, St. John & Roberts

[57] ABSTRACT

A device mountable to the anticavitation plate of a propeller drive unit for a watercraft. The device includes a mounting member and a pivotable plate member mounted thereto. The mounting and plate members are both located below the water line when in operation, with the plate movable between a first position intersecting the backwash from the propeller driving unit and a second position wherein the plate is held parallel to the anticavitation plate and clear of the backwash. A locking assembly interconnects the plate and mounting member for locking the plate in either position. A control cable is attached to the locking assembly and extends therefrom into the watercraft.

13 Claims, 5 Drawing Figures

BACKWASH BAFFLE AND STABILIZING DEVICE FOR PROPELLER DRIVEN WATERCRAFT

BACKGROUND OF THE INVENTION

The present invention is related to devices for obstructing the backwash produced by power drive units for watercraft and more particularly to such devices that are mountable to the anticavitation plate of an outboard or an inboard-outboard type drive unit.

In the sport of troll fishing from a motor driven boat, it often becomes necessary to proceed at a speed that is somewhat slower than possible with the ordinary full idle RPM of the boat motor. This is often the situation with watercraft designed for transportation purposes rather than for fishing. If the motor is run at a slower RPM than is recommended by the manufacturer, it will often overheat, runs rough, or dies frequently. Some boat owners purchase smaller outboard engines attachable to their boat for the specific purpose of trolling. This is both an expensive and inefficient method of operation, as directional control of the boat is sacrificed for the lower speed. In addition, a separate engine mount bracket must be provided as well as additional controls and a portable fuel supply. It therefore becomes desirable to provide some mechanism that may be adapted to existing drive units that will enable proper trolling speeds for such craft and will further not hamper normal forward progress of the boat under ordinary operating conditions.

U.S. Pat. No. 2,787,974 to E. C. Johnson discloses a manually variable trolling plate for outboard motors. This device discloses a plate that is pivotably mounted to a bracket carried by the anticavitation plate of an outboard motor. The trolling plate is connected to an upright adjustment mechanism that projects from the plate to a handle end located behind the boat motor and above the water surface. It is this bracket that interfits with any of a series of notches provided along the length of the adjustment rod to facilitate positioning of the locking plate about its pivot axis. The locking mechanism provides means for positively locking the trolling plate against movement away from the propeller of the attached outboard motor but does not provide a positive means for locking the plate as the motor is operated in reverse. This may be evidenced by FIG. 3 of the drawings wherein the notches indicated by the numeral 60 face forwardly and are inclined upwardly with respect to the trolling plate 45 as shown in FIG. 1. Perhaps tension of spring 65 is sufficient to hold the notches in engagement with the locking plate 61 while the specific motor shown in the drawings is operated in reverse. But the power produced by modern outboard engines as well as inboard-outboard drives, would render utilization of such a locking apparatus impractical. Further, this device may be utilized only with outboard motors or in some other situation wherein the trolling plate unit may remain stationary relative to a movable driving unit.

U.S. Pat. No. 2,050,336 to R. Karasinski discloses a baffle plate for utilization with an outboard motor. The plate is pivoted to the anticavitation plate of the outboard motor and is biased by a torsion spring continuously toward a position intersecting the backwash produced by the propeller. Under a full throttle condition, the backwash produces sufficient force to pivot the baffle plate upwardly and to a condition somewhat parallel to the anticavitation plate. As the motor slows, the spring tension overcomes the thrust of the backwash to pivot the plate downwardly into the backwash to thereby slow forward motion of the boat. Since the torsion spring is utilized to apply a continuous force on the baffle plate, a serious amount of drag is produced to cut the operating efficiency of the attached motor throughout its full RPM range. This is very undesirable when the motor is being utilized for other than trolling purposes. The only locking mechanism provided with this apparatus is an abutment or projection that is formed integrally within the pivotable plate for engaging the anticavitation plate once the trolling plate reaches a downward position. The abutment surface functions to prevent the plate from pivoting into engagement with the propeller.

Another device similar to the Karasinski device is disclosed in U.S. Pat. No. 2,719,503 to D. D. Smith. Smith discloses a trolling plate attachment for outboard motors that is also continuously biased towards a downward position whereat the plate intersects the backwash created by the outboard motor propeller. Again, this device will reduce efficiency of the attached motor when it is operated at speeds faster than that required for trolling or moving extremely slow. In addition, Smith suggests the use of biasing springs of differing tension capacities in correspondence with the horsepower ratings of motors to be utilized therewith. An additional problem that is found when utilizing the spring biased type trolling plates is that when utilized with a motor having a reverse gear capability, little or no control in reverse operation may be had with a plate located in close proximity to the propeller. Experimentation has proven that an air cavity is formed between the plate and propeller when revese movement is attempted. Action of the propeller within the air cavity does not result in the production of a backwash in the desired direction in order to influence reverse directional movement of the boat.

It is a primary object of the present invention to provide a trolling device which incorporates a mechanical adjustment to allow a watercraft to come to a trolling speed without having to lower the idle RPM of the engine below the RPM specified by the manufacturer.

It is a further object to provide such a device that may be adapted to various horsepower inboard-outboard drive engines and outboard engines without necessitating replacement of mechanical parts of the device or the engines.

It is a yet further object to provide such a device that provides full maneuverability of the boat when operation in reverse.

A still further object is to provide such a device that will provide stabilizing action to the boat in all forward speeds and attitudes and, further, controls porpoising and skidding on turns.

An additional object is to provide such a device which allows full maneuverability during turns in all forward speeds.

A further object is to provide such a device that will enable operation by a single boat occupant from any position in the boat.

These and still further objects and advantages will become apparent upon reading the following disclosure, which, taken with the accompanying drawings, describe a preferred form of the present invention. It should be noted however that the drawings and following description are given only by way of example, the invention being defined solely by the appended claims.

BRIEF DESCRIPTION OF THE DRAWINGS

A preferred embodiment of the present invention is illustrated in the accompanying drawings, in which.

DETAILED DESCRIPTION OF A PREFERRED EMBODIMENT

Figure 2:
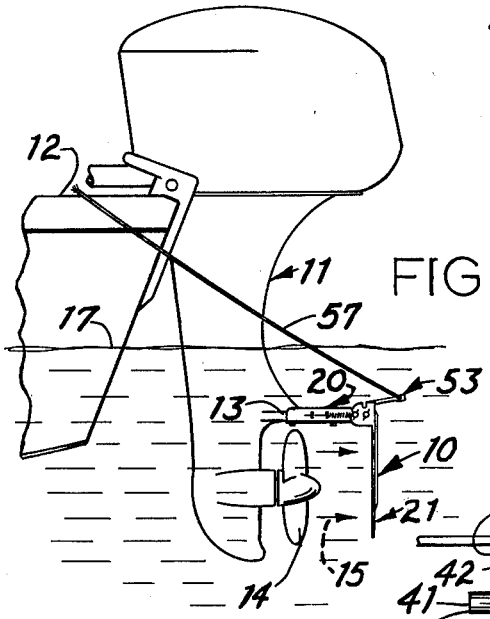
FIG. 2 is a schematic view of the device shown on an outboard motor.

A device incorporating a preferred form of the present invention is illustrated in the drawings and is generally designated therein by the reference character 10. As shown in FIG. 2 of the drawings, the device 10 is mountable to a driving unit 11 of a watercraft 12. Although the unit shown by FIG. 2 is an outboard motor, it is well understood that the device can as easily be utilized with an inboard-outbard type drive unit. The only requirement for mounting the device is that the driving unit have an anticavitation plate 13 located above and extending rearward of the propeller 14. Again, as shown in FIG. 2, the device is operable to intersect the rearwardly moving backwash 15 created by propeller 14 when operated to push the boat forwardly. The device is further operable to move clear of the backwash to allow full maneuverability of the boat in normal or fast operating speeds as well as reverse.

Figure 3:
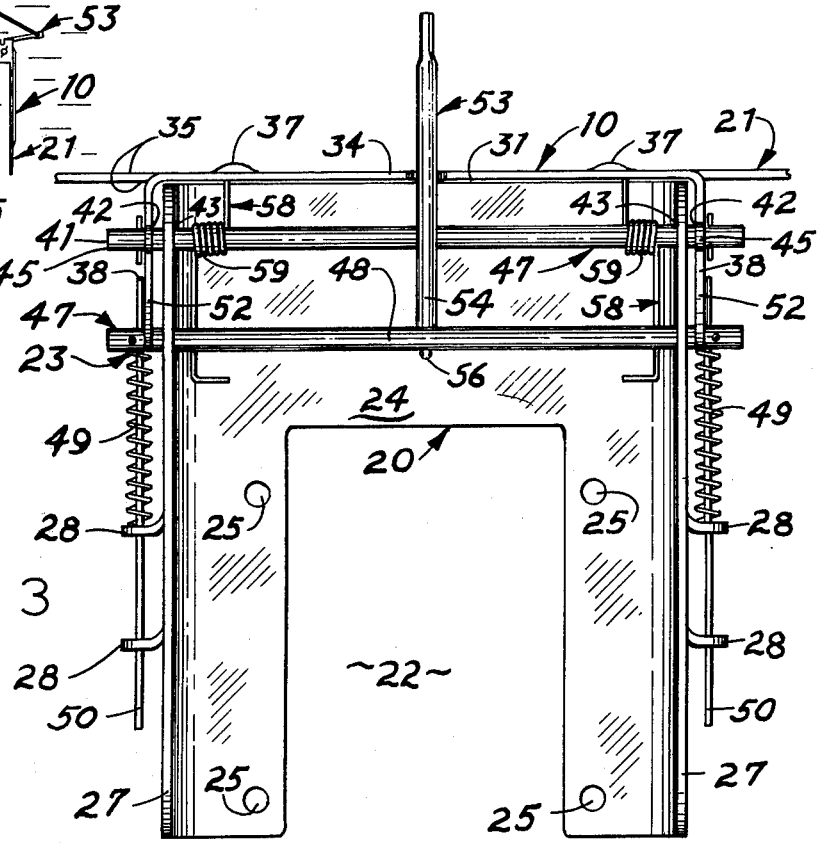
FIG. 3 is an enlarged plan view of the device as seen from above in FIG. 1.
Figures 4, 5:
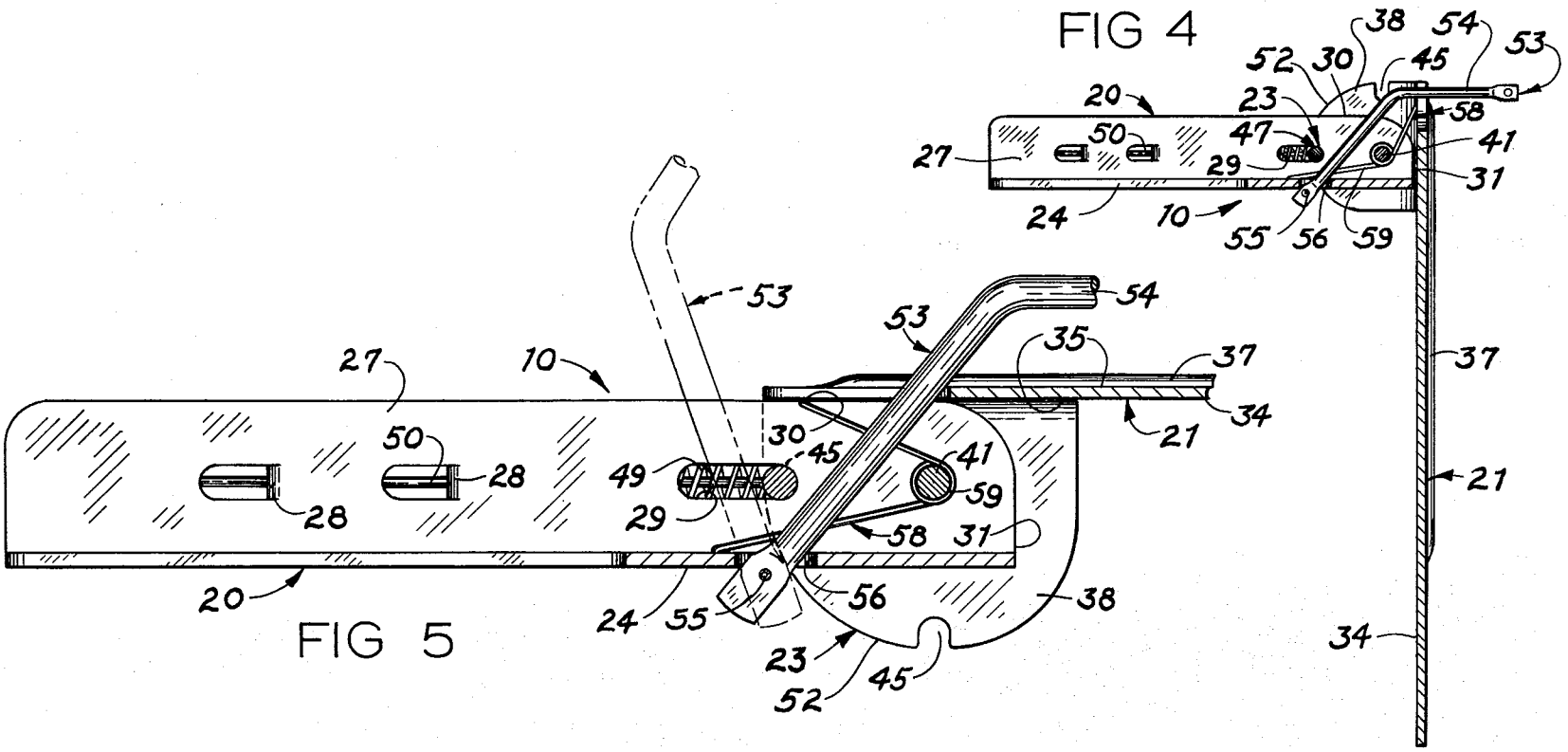
FIG. 4 is a section view taken along line 4—4 in FIG. 1.
FIG. 5 is an enlarged sectional view similar to FIG. 4 only showing different operational position of the elements comprising my invention.

Looking at the device in greater detail it may be understood in comparing FIGS. 4 and 5, that the device is comprised of two relatively movable members. The first is a mounting member 20 that facilitates anchoring of the device to the anticavitation plate 13. The second member is a plate member 21 that is pivotably connected to the mounting member 20. The members 20 and 21 are relatively movable about the pivot axis between a first position as shown in FIGS. 1, 2, 3, and 4 wherein the plate member 21 intersects the backwash 15 and a second position as shown in FIG. 5 with the plate member 21 held substantially parallel to the plane of the anticavitation plate 13. Preferably the plate member moves approximately 90° between the first and second positions.

The plate member 21 and mounting member 20 include inter-fitting releasable locking means 23 that enables the plate 21 to be locked relative to mounting member 20 in either of the first or second positions. The locking means 23 is manually operable to lock or unlock the members in response to actuation by an occupant of the boat or watercraft 12 from substantially any position therein.

It should be noted in FIG. 2 that the entire device is held, when in operation, below the water line 17. Therefore, the entire device is submerged when in operation. This is an important feature in that through this provision, no apparatus extends above the water surface to become entangled by fishing line or will not otherwise hamper normal fishing procedure. In addition, by mounting the entire device at one location on the driving unit 11, pivotal movement of the driving unit is totally unencumbered.

Looking in more detail to the mounting member 20, reference will be made particularly to FIGS. 1, 3 and 5. The mounting member 20 includes a rectangular recess 22 therein for receiving an upright portion of the drive unit that leads to anticavitation plate 13. Member 20 includes an integral horizontal plate 24 that defines the recess 22 and further includes a number of holes 25 for receiving mounting bolts (not shown) that are utilized to anchor the mounting member to anticavitation plate 13. Member 20 also includes upright flanges 27 on opposite sides of the horizontal plate 24. The flanges 27 include integral outwardly projecting tabs 28 and longitudinal slots 29 that are included as part of the locking means 23. Further, an abutment surface 30 is formed integrally along the upwardly facing edge of flanges 27 and second abutment surfaces 31 are formed along a rearwardly facing edge of the flanges 27 and the horizontal plate 24. The abutment surfaces 30, as may be seen in FIG. 5, prevent movement of the plate member 21 beyond a position parallel to the anticavitation plate 13. Abutment surfaces 31 prevent movement of the plate member 21 toward the propeller 14 during undesired reverse movement. Preferably the abutment surfaces 30 and 31 limit the angular displacement of the plate membe 21 to approximately 90°.

Figure 1:
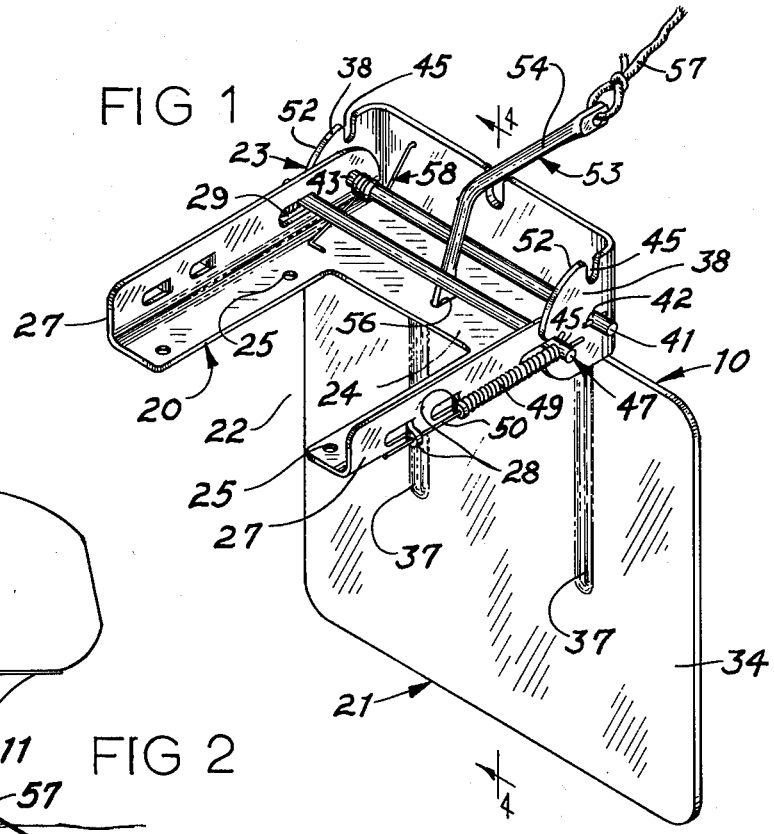
FIG. 1 is a pictorial view of the device.

The plate member 21, as shown in FIGS. 1, 3 and 4, is comprised of a rectangular plate 34 having opposed planar surfaces 35. The rectangular plate 34 is reinforced against bending by reinforcing ridges 37 that extend from the top to bottom plate edges. The upward portion of rectangular plate 34 includes forwardly projecting ears 38. The ears 38 are formed integrally with plate 21, being bent forwardly from a single planar sheet of, preferably, marine aluminum.

The plate member 21 is pivotably connected to the mounting member 2o by a pivot pin 41 that extends through appropriate holes 42 in ears 38 and holes 43 in mounting member 20. The holes 42 and 43 are arranged so the axis for pivot pin 41 is transverse to the backwash and substantially parallel to the plane of anticavitation plate 13. It is important that the axis be so arranged to enable direct, transverse intersection of the plate member 21 with the rearwardly moving backwash 15. If otherwise, the backwash would be deflected in an angular direction and result in turning movement of the boat. Further, if the axis were not parallel to the plane of anticavitation plate 13, features presently accountable for additional control during cruising speeds would be sacrificed.

Having described in detail, the mounting member 20 and plate member 21, a detailed description may now be given of the releasable locking means 23. As previously discussed, the releasable locking means 23 is operatively connected between the mounting member 20 and plate member 21. To begin with, the locking means 23 includes a set of notches 45 that are formed integrally within the ears 38. Notches 45 are located at a specific angular position in relation to the pivot axis of pin 41. Notches 45 communicate with a detent locking means shown generally at 47.

The detent locking means 47 is comprised of a transverse bar 48 that is slidably held within the slots 29. The slots 29 hold bar 48 parallel to pin 41 for movement between a first position engaging one of the aligned pairs of notches 45 and a retracted position completely clear of the ears 38. Guide rods 50 are connected to the ends of bars 48 on opposite sides of the mounting member 20. The guide rods 50 are each held within appropriate holes in the spaced pair of tabs 28 as briefly discussed above. Tabs 28 guide the rods 50 and provide directional support for a pair of compression springs 49 mounted between the rearward tabs 28 and bar 48. The springs 49 continuously urge the bar 48 toward engagement with ears 38.

A cam surface 52 is provided on each ear 38 intermediate the notches 45 therein. Each cam surface 52 is formed on a radius from the axis of pivot pin 41. Cam surfaces 52 slide over bar 48 as plate member 21 moves between the first position as shown in FIGS. 1, 2 and 4, and the second position as shown in FIG. 5.

The angular positioning of notches 45 corresponds directly with the amount of angular movement of the plate member 21 between the two positions as described. The angular space about the pivot axis of pin 41 between notches 45 is 90°, equivalent to the 90° movement of plate member 21 between the first and second positions of plate member 21.

It may be understood that operation of the locking means 23 is automatic in that bar 48 is continuously biased toward notches 45. When not engaged within one of the notches 45, the bar 48 will ride frictionally over cam surface 52 until another set of notches 45 come into alignment with the bar 48. When this happens, bar 48 will slide into the aligned notches to lock plate member 21 against any further angular movement about the pivot axis of pin 41.

In FIG. 5, plate member 21 and mounting member 20 are shown locked in the second position. With this arrangement, the forces produced about the axis of pivot pin 41 result in shearing stress at the bar 48 between notches 45 and upright flanges 27 of mounting member 20. This is true if a downward force (as viewed in FIG. 5) were directed against plate member 21 rearward of the pivot pin 41. An upward force against plate member 21 in the same position however brings the plate into contact with the upper abutment surface 30 formed on the flanges 27. This is an important feature when considering the device in operation on a forwardly moving boat. "Porpoising" or up and downward movement of the boat when moving at relatively fast speeds will produce a substantial amount of torsion about the axis of pivot pin 41. Provision of abutment surface 30 serves to increase resistance to shear when the plate is moved downwardly in the water. In addition, the provision of abutment surface 31 along the rearward edge of mounting member removes shear stress from bar 48 when the boat is moved inadvertently in a rearward direction while the plate member 21 is held at the second position (FIGS. 2 and 4). In this condition, the plate 21 would normally be pulled toward the propeller 14.

A control means 53 is provided to enable remote operation of the locking means 23 from relatively any position within the boat. Control means 53 is simply comprised of a lever 54 that is pivotably connected to the mounting member 20 for operative engagement with bar 48 and a length of cord 57. Lever 54 is pivoted at its lower end by a pin 55 (FIGS. 4 and 5) that loosely slides against the bottom surface of mounting plate 20. The lever extends through a longitudinal slot 56 formed in the mounting member 20 to enable movement between positions as shown by solid and phantom lines in FIG. 5. Cord 57 is connected at one end of the lever 54 and extends above the water line and into the boat (FIG. 2). The cord 57 may be of any length and therefore may be utilized from any position on the watercraft to facilitate operation of the device to move plate member 21 between either the first or second positions.

The cord 57 may be pulled from within the boat to move lever 54 forwardly to engage bar 48. The bar 48 is then forced by the lever 54 to slide forwardly away from the engaged notches 45. This frees plate member 21 for free pivotal movement about the axis of pivot pin 41. Therefore, when the plate is held in the second position, disengagement of bar 48 will enable downward pivotal movement of the plate to the first position as shown in FIG. 4. Likewise, if the plate is presently held at the first position, engagement and operation of the control means 53 to disengage bar 48 from the notches 45 will enable resulting movement of the plate from the first position to the second position.

It has been found that the plate member 21 will move freely between the first and second positions in response to gravitation and directional movement of the boat. For example, if it is desired to move the plate 21 from the second position to the first position, the user may simply disengage the bar 48 from the appropriate notches 45 by pulling cord 57. The then freed plate member 21 will fall gravitationally toward the first position where the bar 48 will snap into the appropriate notches 45, locking the plate in position. If the desired movement of plate member 21 is to be from the first position to the second position, the user simply again pulls the cord 57 to disengage bar 48 from notches 45 to allow free pivotal movement of the member 21. Forward thrust from the driving unit will produce corresponding pivotal movement of the plate member 21 toward the first position.

To further assist movement of the plate member 21 from the second position to the first position, a biasing means 58 is provided. Means 58 is simply comprised of a pair of torsion springs 59 that are wound about the pivot pin 41 with one arm connected to plate member 21 and the remaining arm connected to mounting member 20. Torsion springs 59 are designed to produce a continuous torsional force against the plate member 21 to urge its movement toward the first position. Provision of the torsion springs 59 simply hastens movement of plate member 21 toward the first position.

Before operating the device, the user must of course first mount the device to the driving unit of a watercraft. This is accomplished simply by positioning the mounting member 20 on the anticavitation plate 13 of the driving unit so the axis of pivot pin 41 is transverse to the intended rearward thrust or backwash of the propeller 14. In other words, the pivot axis of pin 41 must be aligned perpendicular to the rotational axis of propeller 14. When securely anchored to the anticavitation plate 13, the device is ready for use. Assuming the device has been mounted to the driving unit with plate member 21 located in the second position, the motor may operate at cruising RPM to move the boat quickly to an area where he wishes to move at a much slower rate. At this point, the operator slows or stops forward progress of the boat while pulling the flexible cord 57. This serves to disengage bar 48 from appropriate notches 45 and enables downward pivotal movement of the plate member 21 from the second position to the first position. As plate member 21 reaches the second position, the bar 48 snaps under the compressive force of springs 49 into the complementary notches 45 to positively lock the plate member in that position. As shown in FIG. 2, the plate member 21 transversely intersects the backwash produced by the operating propeller 14 to substantially slow the forward progression of the boat.

When normal cruising speed is desired to be obtained, the user may simply again pull on the flexible cord 57 while simultaneously increasing the operating speed of the driving unit. The increased backwash will serve to pivot the plate member 21 upwardly to the second position. The bar 48 will ride along the cam surface 52 until it snaps into the appropriate notches 45, positively locking the plate in the second position.

It should be noted that since the plate is locked against any pivotal movement about the axis of pin 41 while in the second position, that the plate member 21 will act as a stabilizing unit for the watercraft while it is moving either forward or backwardly. The stabilizing feature has been proven to be very advantageous in that it reduces porpoising of the boat when moving at relatively high speeds and further assists in preventing "skidding" of the boat when in tight turns. Also, since the plate is locked relative to pivotal movement, the driving unit may be utilized to move the boat in a reverse motion without danger of moving the plate member 21 downwardly or into engagement with the propeller 14. Reinforcing by the abutment surfaces 30 and 31 assures that accidental reverse movement of the driving unit when the plate is in the "down" position, will not result in angular movement of the plate toward the propeller nor will excessive forward thrust of the propeller result in damage to the device from additional backwash.

The above description and attached drawings are given only by way of example, it being understood that the invention is defined only by the following claims.

What I claim is:

1. A backwash baffle and stabilizing device mountable to the anticavitation plate of a propeller drive unit for a watercraft to deflect the backwash from the propeller drive unit; comprising:

a mounting member adapted to be anchored to the anticavitation plate of the propeller drive unit;

a plate member pivotably mounted to the mounting member for movement about a prescribed axis between (a) a first position intersecting the backwash, and (b) a second position displaced angularly about the axis from the first position clear of the backwash and in a plane substantially parallel to the anticavitation plate;

a pair of notches formed within one of the members and angularly spaced apart about the axis so the angle included between the notches is equal to the angle between the first position and the second position of the plate member;

detent locking means on the remaining member biased toward the notches on the one member for engaging a selected notch to lock the plate member in either of the positions against movement about the axis relative to the mounting member; and control means for releasing the detent means from either of the notches.

2. The device as defined by claim 1 further comprising biasing means between the mounting member and plate member for continuously urging the plate member about the axis toward the first position.

3. The device as defined in claim 1 further comprising a first abutment on the mounting plate for engaging the plate member when in the first position to prevent additional pivotal movement of the plate member beyond the first position; and a second abutment on the mounting plate for engaging the plate member when in the second position to prevent additional pivotal movement of the plate member beyond the second position.

4. The device as defined by claim 1, wherein:

the plate member includes a planar rectangular baffle portion;

ears protruding perpendicularly from the baffle position;

a pivot pin interconnecting the ears and mounting member along the prescribed axis; and wherein the notches are formed integrally in the ears.

5. The device as defined by claim 4 wherein the detent means is comprised of:

a rod slidably carried in an elongated slot formed within the mounting member;

a spring interconnecting the rod and mounting member to bias the rod toward the ears; and wherein a cam means is provided between the notches on the ears for holding the rod in an inoperative condition until the plate member is moved to either of the positions.

6. The device as defined by claim 1 wherein the control means is comprised of a flexible cord extending from the detent means into the watercraft.

7. A backwash baffle and stabilizing device mountable to the anticavitation plate of a drive unit for operation below the operative water line of a watercraft, comprising:

a mounting member adapted to be anchored to the anticavitation plate;

a plate member pivotably mounted to the mounting member for movement about an axis between (a) a first position intersecting backwash produced by the drive unit and (b) a second position angularly displaced from the first position and in a plane parallel to the anticavitation plate;

releasable locking means mounted on one of the members directly interconnecting the members below the water line for operatively locking and unlocking the plate member relative to the mounting member in either of the positions thereof.

8. The device as defined by claim 7 further comprising a flexible remote control cord extending from the locking means into the watercraft.

9. The device as defined by claim 7 further comprising biasing means between the mounting member and plate member for continuously urging the plate member about the axis toward the first position.

10. The device as defined by claim 7 further comprising a first abutment on the mounting plate for engaging the plate member when in the first position to prevent additional pivotal movement of the plate member beyond the first position.

11. The device as defined in claim 7 wherein the locking means is comprised of:

a pair of notches formed within one of the members and angularly spaced apart about the axis with the angle included between the notches being equal to the angle between the first position and the second position of the plate member; and detent means on the remaining member biased toward the notches in the one member for engaging a selected notch to lock the plate member in one of the positions against movement about the axis relative to the mounting member.

12. The device as defined by claim 11, wherein:

the plate member includes a planar rectangular baffle portion;

ears protruding perpendicularly from the baffle portion;

a pivot pin interconnecting the ears and mounting member along the prescribed axis; and wherein the notches are formed integrally in the ears.

13. The device as defined by claim 12 wherein the detent means is comprised of a rod slidably carried in an elongated slot formed within the mounting member; a spring interconnecting the rod and mounting member to bias the rod toward the ears; and wherein a cam means is provided between the notches on the ears for holding the rod in an inoperative condition until the plate member is moved to either of the positions.

* * * * *

UNITED STATES PATENT AND TRADEMARK OFFICE
CERTIFICATE OF CORRECTION

PATENT NO. : B1 3,965,838

DATED : October 10, 1989

INVENTOR(S) : Frank O. Uht

It is certified that error appears in the above-identified patent and that said Letters Patent is hereby corrected as shown below:

Title page, item [75] inventor: cancel "Jack Hughes; a part interest, Bellevue, Wash." and substitute -- Frank O. Uht, Bellevue, Wash. --.

Item [73], assignee: cancel "R. Wayne Uht, Bellevue, Wash." and substitute "Jack Hughes, Bellevue, Wash., and R. Wayne Uht--.

Signed and Sealed this

Nineteenth Day of February, 1991

*Attest:*

HARRY F. MANBECK, JR.

*Attesting Officer*

*Commissioner of Patents and Trademarks*

REEXAMINATION CERTIFICATE (1137th)

United States Patent [19]

Uht

[11] B1 3,965,838

[45] Certificate Issued Oct. 10, 1989

[54] BACKWASH BAFFLE AND STABILIZING DEVICE FOR PROPELLER DRIVEN WATERCRAFT

[75] Inventor: Jack Hughes; a part interest, Bellevue, Wash.

[73] Assignee: R. Wayne Uht, Bellevue, Wash.

Reexamination Request:
No. 90/001,434, Feb. 1, 1988

Reexamination Certificate for:

| | |
|---|---|
| Patent No.: | **3,965,838** |
| Issued: | **Jun. 29, 1976** |
| Appl. No.: | **581,160** |
| Filed: | **May 27, 1975** |

[51] Int. Cl.[4] ..... B63H 25/48
[52] U.S. Cl. ..... 114/145 A
[58] Field of Search ..... 114/145 R, 145 A, 285, 114/298; 440/78; 74/527

[56] References Cited

U.S. PATENT DOCUMENTS

| | | | |
|---|---|---|---|
| 1,576,237 | 3/1926 | Dawson | 114/145 A |
| 1,799,455 | 4/1931 | Cavert | 114/145 R |
| 2,050,336 | 8/1936 | Karasinski | 115/17 |
| 2,230,958 | 2/1941 | Langdon | 114/145 |
| 2,415,605 | 2/1947 | Newby | 114/298 |
| 2,426,805 | 9/1947 | Whiting | 114/145 |
| 2,654,336 | 10/1953 | Katzung et al. | 115/0.5 |
| 2,719,503 | 10/1955 | Smith | 115/18 |
| 2,751,875 | 6/1956 | Henry | 115/18 |
| 2,787,974 | 4/1957 | Johnson | 115/18 |
| 2,914,019 | 11/1959 | Gewin | 115/18 |
| 2,959,148 | 11/1960 | Canazzi | 115/17 |
| 2,998,795 | 9/1961 | Downie et al. | 114/145 |
| 3,046,928 | 7/1962 | Sherrill | 114/66.5 |
| 3,091,977 | 6/1963 | Kiekhaefer | 74/501 |
| 3,117,548 | 6/1964 | Rasmussen | 115/17 |
| 3,136,280 | 6/1964 | Bergum | 115/17 |
| 3,209,716 | 10/1965 | Hartley | 114/145 |
| 3,384,045 | 5/1968 | Lusby | 114/145 |
| 3,581,699 | 6/1971 | Pedersen | 114/145 |
| 3,603,277 | 9/1971 | Manary et al. | 114/145 A |
| 3,730,127 | 5/1973 | Pedersen | 114/145 A |

*Primary Examiner*—Sherman D. Basinger

[57] ABSTRACT

A device mountable to the anticavitation plate of a propeller drive unit for a watercraft. The device includes a mounting member and a pivotable plate member mounted thereto. The mounting and plate members are both located below the water line when in operation, with the plate movable between a first position intersecting the backwash from the propeller driving unit and a second position wherein the plate is held parallel to the anticavitation plate and clear of the backwash. A locking assembly interconnects the plate and mounting member for locking the plate in either position. A control cable is attached to the locking assembly and extends therefrom into the watercraft.

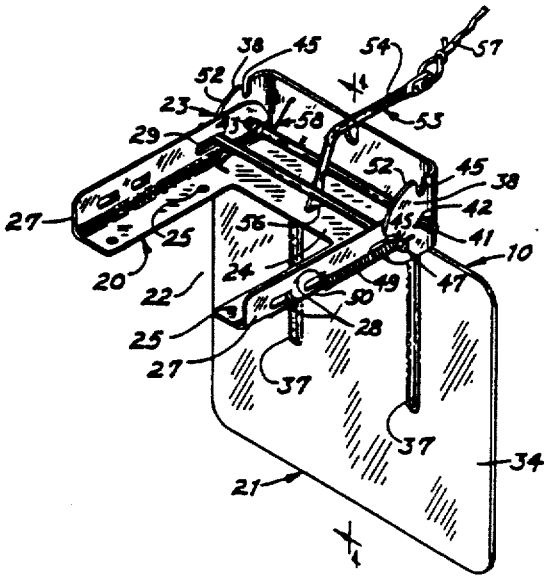

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–4, 7 and 9–11 are determined to be patentable as amended.

Claims 5, 6, 8, 12 and 13, dependent on an amended claim, are determined to be patentable.

1. A *combination trolling* backwash baffle and *cruise* stabilizing device mountable to the anticavitation plate of a propeller drive unit for a watercraft to [deflect] *control* the backwash from the propeller drive unit; comprising:

a mounting member adapted to be anchored to the anticavitation plate of the propeller drive unit;

a plate member pivotably mounted to the mounting member for movement about a prescribed axis between (a) [a first] *a trolling* position intersecting the backwash[,] *to slow the watercraft for trolling at low speeds;* and (b) [a second] *a cruise* position displaced angularly about the axis from the [first] *trolling* position clear of the backwash and in a plane substantially parallel to the anticavitation plate *to guide the backwash to increase maneuverability at cruise speeds by reducing porpoising and skidding in turns;* a pair of notches formed within one of the members and angularly spaced apart about the axis so the angle included between the notches is equal to the angle between the [first] *trolling* position and the [second] *cruise* position of the plate member;

detent locking means on the remaining member biased toward the notches on the one member for engaging a selected notch to lock the plate member in either of the positions against movement about the axis relative to the mounting member; and control means for releasing the detent means from either of the notches.

2. The device as defined by claim 1 further comprising biasing means between the mounting member and plate member for continuously urging the plate member about the axis toward the [first] *trolling* position.

3. The device as defined in claim 1 further comprising a first abutment on the mounting plate for engaging the plate member when in the [first] *trolling* position to prevent additional pivotal movement of the plate member beyond the [first] *trolling* position; and a second abutment on the mounting plate for engaging the plate member when in the [second] *cruise* position to prevent additional pivotal movement of the plate member beyond the [second] *cruise* position.

4. The device as defined by claim 1, wherein:

the plate member includes a planar rectangular baffle portion;

ears protruding perpendicularly from the baffle [position] *portion;* a pivot pin interconnecting the ears and mounting member along the prescribed axis; and wherein the notches are formed integrally in the ears.

7. A *combination trolling* backwash baffle and *cruise* stabilizing device mountable to the anticavitation plate of a drive unit for operation below the operative water line of a watercraft, comprising:

a mounting member adapted to be anchored to the anticavitation plate;

a plate member pivotably mounted to the mounting member for movement about an axis between (a) a [first] *trolling* position intersecting backwash produced by the drive unit *to slow the watercraft for trolling at low speeds;* and (b) a [second] *cruise* position angularly displaced from the [first] *trolling* position and in a plane parallel to the anticavitation plate *to guide the backwash to increase maneuverability at cruise speeds by reducing porpoising and skidding in turns;* releasable locking means mounted on one of the members directly interconnecting the members below the water line for operatively locking and unlocking the plate member relative to the mounting member in either of the positions thereof.

9. The device as defined by claim 7 further comprising biasing means between the mounting member and plate member for continuously urging the plate member about the axis toward the [first] *trolling* position.

10. The device as defined by claim 7 further comprising a first abutment on the mounting plate for engaging the plate member when in the [first] *trolling* position to prevent additional pivotal movement of the plate member beyond the [first] *trolling* position.

11. The device as defined in claim 7 wherein the locking means is comprised of:

a pair of notches formed within one of the members and angularly spaced apart about the axis with the angle included between the notches being equal to the angle between the [first] *trolling* position and the [second] *cruise* position of the plate member; and detent means on the remaining member biased toward the notches in the one member for engaging a selected notch to lock the plate member in one of the positions against movement about the axis relative to the mounting member.

* * * * *